United States Patent [19]

Broenner

[11] Patent Number: 4,769,831

[45] Date of Patent: Sep. 6, 1988

[54] ROTATING ANODE X-RAY TUBE

[75] Inventor: Karlheinz Broenner, Erlangen, Fed. Rep. of Germany

[73] Assignee: Siemens Aktiengesellschaft, Berlin and Munich, Fed. Rep. of Germany

[21] Appl. No.: 912,276

[22] Filed: Sep. 29, 1986

[30] Foreign Application Priority Data

Nov. 13, 1985 [DE] Fed. Rep. of Germany ..... 3540303

[51] Int. Cl.[4] ..... H01J 35/26

[52] U.S. Cl. ..... 378/125; 378/144

[58] Field of Search ..... 378/125, 144, 93, 132; 310/308, 309, 232

[56] References Cited

U.S. PATENT DOCUMENTS 2,885,599 5/1959 Hand ..... 310/309
4,167,671 9/1979 Boden et al. .
4,414,681 11/1983 Seifert .
4,417,171 11/1983 Schmitmann .
4,485,428 11/1984 Harris ..... 250/324
4,608,707 8/1986 Gabbay et al. ..... 378/132

FOREIGN PATENT DOCUMENTS 0126668 11/1984 European Pat. Off. .
0132180 1/1985 European Pat. Off. .

*Primary Examiner*—Janice A. Howell
*Assistant Examiner*—David P. Porta
*Attorney, Agent, or Firm*—Hill, Van Santen, Steadman & Simpson

[57] ABSTRACT

A rotating anode x-ray tube has an anode magnetically seated in a housing in non-contacting fashion. For non-contacting transmission and dissipation of the anode current, a hollow cylindrical rotor of the anode is provided with ribs on its interior surface. A stationary hollow cylinder is disposed inside of the rotor, the stationary hollow cylinder being also provided with ribs in registry with the ribs on the interior of the rotor, and being connected to the anode lead. Current is thereby transferred from the stationary cylinder to the rotating hollow cylinder by corona discharge.

2 Claims, 1 Drawing Sheet

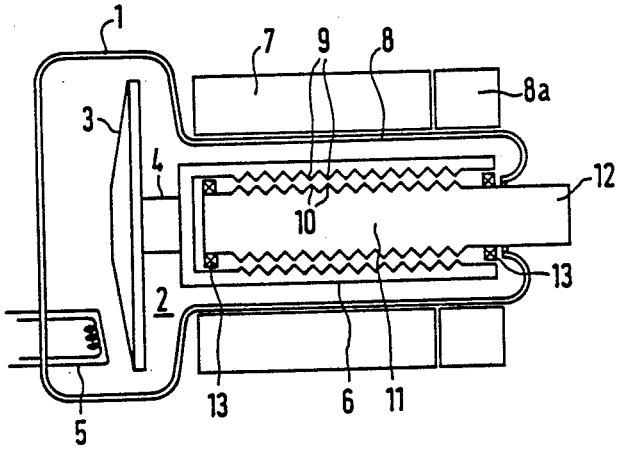
1
7
9
8
8a
3
4
12
10
13
2
13
6
11
5

ROTATING ANODE X-RAY TUBE

BACKGROUND OF THE INVENTION

1. Field of the Invention

The present invention relates to rotating anode x-ray tubes, and in particular to such x-ray tubes wherein the anode is magnetically seated in a housing in a non-contacting manner.

2. Description of the Prior Art

A rotating anode x-ray tube is described in German No. OS 30 43 670 wherein the shaft of the anode is magnetically seated in a housing in a non-contacting manner. The seating of the anode shaft is accomplished by a non-contacting magnetic bearing, which axially and radially holds the shaft. Because the anode is maintained suspended during operation, a problem exists in carrying away the anode current. The solution is this problem described in German No. OS 30 43 670 is to arrange at least one auxiliary cathode on a component rotating together with the anode, this auxiliary cathode having a stationary auxiliary anode allocated thereto. Dissipation of the anode current occurs through an auxiliary diode which is disposed at the anode side, so that direct contact between the auxiliary anode and auxiliary cathode does not occur. As a result of the required auxiliary cathode and auxiliary anode, however, the outlay for this structure is high.

SUMMARY OF THE INVENTION

It is an object of the present invention to provide a rotating anode x-ray tube wherein the anode is magnetically mounted in a housing in a non-contacting manner and wherein a means for eliminating the anode current is provided having a reduced structural outlay.

The above object is achieved in accordance with the principles of the present invention in a rotating anode x-ray tube wherein the anode has a cylindrical shaft rotating therewith which has an exterior surface with ribs thereon. Corresponding ribs are provided on a stationary portion of the x-ray tube housing opposite the ribs on the cylindrical shaft. A current transfer between the rotating shaft and the stationary part occurs by corona or brush discharge. In the x-ray tube disclosed herein, the anode floats in a magnetic field. The current transfer from the anode to the anode terminal occurs by corona discharge because an adequately large surface which is electrically connected to the anode and a surface lying closely adjacent opposite this surface are provided. The latter surface is fashioned such that corona discharge can easily occur between the surface. The ribs on the rotating and stationary parts can be fashioned in the form of a thread with a suitable coating of, for example, tungsten.

DESCRIPTION OF THE DRAWINGS

The single FIGURE shows a side view in section of a rotating anode x-ray tube constructed in accordance with the principles of the present invention.

DESCRIPTION OF THE PREFERRED EMBODIMENTS

As shown in the single FIGURE, an x-ray tube has a glass housing 1 in which an anode 2 rotates. The anode

2 has an anode plate or dish 3 which is secured on a shaft 4 and to which a cathode 5 is allocated in a known manner. The cathode 5 supplies the electron current required for generating x-radiation. The shaft 4 is connected to a rotor 6 which rotates the anode 2 and permits magnetic support thereof. The anode 2 is thus held magnetically suspended during rotation. For this purpose, a stationary magnetic winding 7 is provided surrounding a neck 8 of the glass housing 1. A drive winding **8*a* is provided for rotating the anode 2**.

The anode 2 has no mechanical contact whatsoever to stationary parts while it rotates. In order for the anode current to be transmitted away in a non-contacting manner, the rotor 6 is in the form of a hollow cylinder having a plurality of ribs 9 on its interior surface. A stationary cylinder 11 is provided inside the hollow rotor 6 which has corresponding ribs 10 on an exterior surface thereof. The stationary cylinder 11 is connected to an anode terminal 12.

As a consequence of the large surfaces on the inside of the rotor 6 and the outside of the cylinder 11 formed by the respective sets of ribs 9 and 10, corona or brush discharge occurs between the rotor 6 and the cylinder 11, which achieves transfer of current between those components.

The cylinder 11 has two ball bearings 13 disposed at a distance from the inside of the rotor 6 during rotation of the anode 2, which support the rotor 2 during standstill.

Although modifications and changes may be suggested by those skilled in the art it is the intention of the inventor to embody within the patent warranted hereon all changes and modifications as reasonably and properly come within the scope of his contribution to the art.

I claim as my invention:

1. In a rotating anode x-ray tube having an anode mounted an a shaft and means for magnetically seating said anode in a housing during rotation in a non-contacting manner, and having an anode terminal, the improvement comprising:

a hollow rotor connected to said anode shaft, said hollow rotor having an interior surface with ribs thereon; and a stationary cylinder disposed inside said hollow rotor and connected to said anode terminal, said stationary cylinder having an exterior surface with ribs thereon corresponding to said ribs in said interior of said rotor and disposed with respect thereto for transferring current between said rotor and said cylinder by corona discharge.

2. In a rotating anode x-ray tube having an anode connected to a shaft and means for magnetically seating said anode in a housing in a non-contacting manner and having an anode terminal, the improvement comprising:

a first cylindrical part connected to said anode shaft for co-rotation therewith having a surface with ribs thereon; and a stationary cylindrical part disposed in said housing having a surface with ribs thereon disposed spaced from and adjacent said ribs of said co-rotating cylindrical part for transferring current between said co-rotating part and said stationary part by corona discharge.

* * * * *